US005179776A

United States Patent [19]

Boenitz et al.

[11] Patent Number: 5,179,776

[45] Date of Patent: Jan. 19, 1993

[54] METHOD OF RESTRAINING AN AMORPHOUS METAL CORE

[75] Inventors: Maurice J. Boenitz, Lenox, Mass.; Harry T. Denner, Waukesha, Wis.

[73] Assignee: Cooper Power Systems, Inc., Coraopolis, Pa.

[21] Appl. No.: 674,885

[22] Filed: Mar. 26, 1991

[51] Int. Cl.[5] ..... H01F 41/02

[52] U.S. Cl. ..... 29/609; 336/206; 336/209; 336/213

[58] Field of Search ..... 29/609, 605; 336/206, 336/209, 210, 219, 213, 234

[56] References Cited

U.S. PATENT DOCUMENTS

| | | | |
|---|---|---|---|
| 2,985,858 | 5/1961 | Lattizzori | 336/210 |
| 4,599,594 | 7/1986 | Siman . | |
| 4,648,929 | 3/1987 | Siman | 336/219 X |
| 4,663,605 | 5/1987 | Lee . | |
| 4,673,907 | 6/1987 | Lee . | |
| 4,734,975 | 4/1988 | Ballard et al. . | |
| 4,790,064 | 12/1988 | Ballard et al. . | |
| 4,903,396 | 2/1990 | Grimes et al. . | |
| 4,910,863 | 3/1990 | Valencic et al. . | |

*Primary Examiner*—Carl E. Hall
*Attorney, Agent, or Firm*—Wigman & Cohen

[57] ABSTRACT

A method of making an amorphous metal transformer core includes the steps of providing an amorphous metal core having two legs which are connected by an upper and a lower yoke, wrapping each of the legs with a sheet of flexible material which is capable of withstanding, without degradation, the temperature which is required to anneal the amorphous metal core, and then annealing the amorphous metal core. An amorphous metal transformer core includes a stack of amorphous metal laminations, the stack being formed into two legs which are connected by upper and lower yokes in which the legs are wrapped with a sheet of flexible material which is capable of withstanding, without degradation, the temperature required to anneal the amorphous metal core.

12 Claims, 1 Drawing Sheet

METHOD OF RESTRAINING AN AMORPHOUS METAL CORE

FIELD OF THE INVENTION

The present invention relates to a method of making an amorphous metal core for use in a transformer, and more particularly to such a method in which the amorphous core is restrained prior to the annealing step in forming the amorphous core.

DESCRIPTION OF THE PRIOR ART

Amorphous metal cores manufactured from stacks of amorphous metal strips are well-known in the art. Such cores are used in the manufacture of transformer cores as is described in U.S. Pat. Nos. 4,734,975 and 4,790,064, both to Ballard et al.

It is also known to anneal the amorphous metal cores as taught by U.S. Pat. No. 4,910,863 to Valencic et al., and to provide an enclosure about the core so as to provide a containment means for chips which occasionally break off the amorphous metal strips, as illustrated in U.S. Pat. No. 4,673,907 to Lee. The Lee patent, as well as U.S. Pat. No. 4,663,605 also to Lee, both disclose clamping systems for supporting the core in a transformer. Further, U.S. Pat. No. 4,903,396 to Grimes et al. discloses a method of containing an amorphous core joint in which an oil compatible porous pad is introduced between pressure plates and the face of the core joint.

The purpose of the heat treatment or annealing process is to improve the magnetic properties of the core by relieving the internal stresses in the core material and to align the magnetic domains in the direction the core will be magnetized in the transformer.

Presently, wound amorphous metal cores are restrained in a desired shape by temporary fixtures which are attached to the cores after they are formed and which are removed after the cores are heat treated. As illustrated in the aforementioned U.S. patents to Lee, various means have been devised to hold the amorphous metal core in the desired shape in the transformer. Amorphous metal cores, unless so constrained, would generally collapse under their own weight.

Further, as is well recognized in the art, amorphous metal transformer cores are expensive to manufacture and are not presently manufactured at the high volume production rates that are possible for transformer cores made of more traditional soft magnetic materials.

SUMMARY AND OBJECTS OF THE INVENTION

It is a primary object of this invention to provide a method of manufacturing amorphous metal cores for use in transformers which reduce the cost of the manufacturing process.

More particularly, it is an object of this invention to provide a method of manufacturing amorphous metal cores which facilitates the manufacturing process.

It is another object of this invention to provide a method of promoting core rigidity and consolidating the laminations of the core.

Yet another object of this invention is to provide a permanent wrapping for holding the core legs together during lacing through the coils.

Still another object of this invention is to provide a method of protecting the edges of the core during the handling process.

It is another object of this invention to provide a method of accomplishing the foregoing objects which can be applied to the core after forming and which will withstand the annealing environment.

Yet another object of this invention is to provide a method of promoting the containment of chips from the amorphous metal material.

Briefly described, the aforementioned objects are accomplished according to the invention by providing a method of making an amorphous metal transformer core which includes the steps of providing an amorphous metal core having two legs which are connected by a top and a bottom yoke, wrapping each of the legs with a sheet of flexible material which is capable of withstanding, without degradation, the temperature which is required to anneal the amorphous metal core, and then annealing the amorphous metal core. The aforementioned objects are also accomplished by providing an amorphous metal transformer core which includes a stack of amorphous metal laminations, the stack being formed into two legs which are connected by top and bottom yokes in which the legs are wrapped with a sheet of flexible material which is capable of withstanding, without degradation, the temperature required to anneal the amorphous metal core.

In addition to wrapping the legs of the core, the top, unjointed yoke, may also be wrapped with the high-temperature resistant flexible material.

With the foregoing and other objects advantages and features of the invention that will become hereinafter apparent, the nature of the invention may be more clearly understood by reference to the following detailed description of the invention, the appended claims and to the several views illustrated in the attached drawings.

DETAILED DESCRIPTION OF THE PREFERRED EMBODIMENTS

Figure 1:
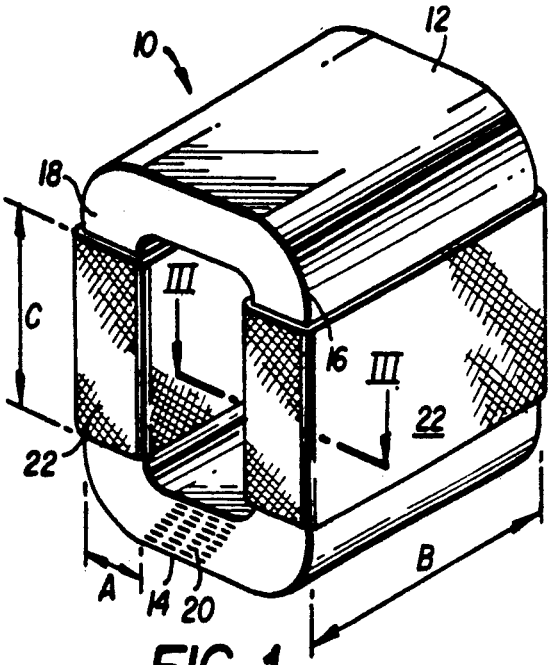
FIG. 1 is a perspective view of the amorphous metal core including the wrapping in accordance with the invention.

Referring now to the drawing figures wherein like elements are designated by the like numerals throughout, FIG. 1 depicts an amorphous metal core, generally indicated by reference numeral 10.

Core 10 has a primary use as the core of a transformer, as is generally known in the art. The core 10 has a generally rectangular shape and comprises upper and lower sides or portions, commonly known as yokes 12, 14, which connect a pair of core legs 16, 18 into a closed magnetic path. In the core 10 illustrated in FIG. 1, the magnetic loop is closed by the lower yoke 14 which is jointed, the joint 20 being provided by interleaving the laminations or strips of amorphous metal, as is known in the art, for example, as shown in the aforementioned U.S. Pat. No. 4,790,064 to Ballard et al.

Figure 2:
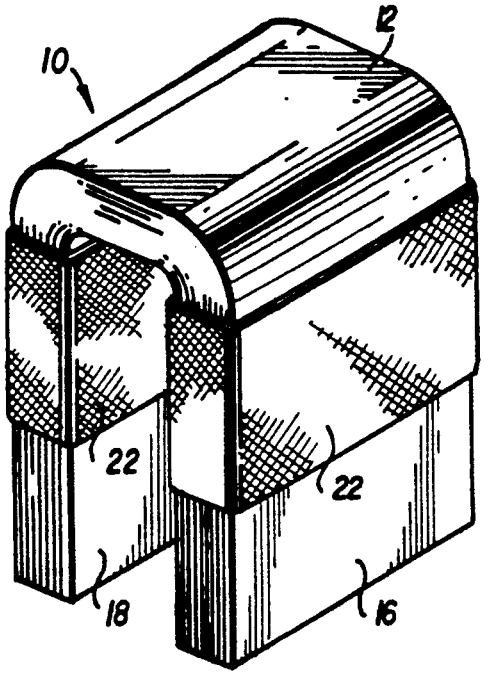
FIG. 2 is a view similar to FIG. 1, showing the joint of the core in the unjoined condition, with the bottom yoke of the core open and unwrapped, also in accordance with the invention.

Referring now to FIG. 2, it will be seen that the core 10 of FIG. 1 is illustrated in the condition in which the joint 20 has been opened, with core legs 16 and 18 being disengaged at their free ends to form a generally inverted U-shaped core structure. In the configuration of FIG. 2, the core loop may be laced through the coil windings of a transformer, and the yoke joints are then reclosed to complete the core/coil assembly.

In accordance with the present invention, core legs 16, 18 are provided with a flexible wrapping material or tape 22 which encircles the core legs. The core volume enclosed by each wrap of tape 22 is established by the lamination stack height shown as dimension A, the linear portion of the legs 16, 18 shown as dimension C, and the lamination width shown as dimension B. By means of wrap 22, the laminations in the core legs 16, 18 are consolidated to increase rigidity of the core and facilitate handling of the core.

Figure 4:
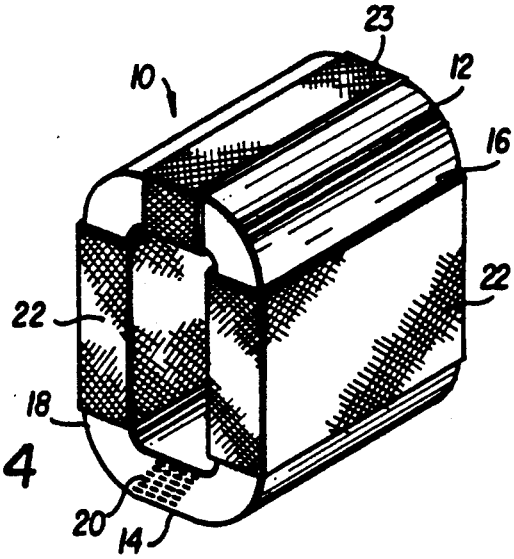
FIG. 4 is a view similar to FIGS. 1 and 2, showing an additional embodiment of the invention in which the top yoke of the core is wrapped, in addition to the core legs, also in accordance with the invention.

Optionally, the non-jointed top yoke 12 of the core may similarly be wrapped, as illustrated in FIG. 4, showing wrap 23. This is particularly the case for larger cores, in which rigidity will be improved by inclusion of wrap 23 around top yoke 12.

Figure 3:
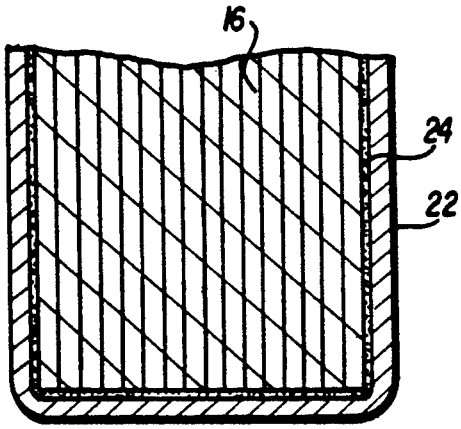
FIG. 3 is a partial sectional view taken along line III—III of FIG. 1.

Regarding the wrap 22, 23, more specifically, the wrapping material will ideally have a tacky adhesive 24 (FIG. 3) applied to the surface of the wraps 22 which contact the outer periphery of core 10 at core legs 16, 18 and, optionally, the surface of wrap 23 which contacts the core at top yoke 12.

The wrapping material has the property such that the material will not significantly degrade or deteriorate at the temperature required to anneal the typical amorphous metal laminations. Typically, the amorphous metal laminations are annealed at temperatures in the range of 330°-380° C. Further, the wrapping material has the property such that it retains sufficient strength after the heat treatment to consolidate the lamination stack and promote core rigidity.

Wraps 22 and, optionally, wrap 23, may take the form of an open mesh, similar to a screen. The open mesh structure facilitates heat transfer by convection during the heat treating process.

Typical wrapping materials include a high temperature inorganic material, such as a metallic or glass screen or mesh. Because of the high temperatures involved in the annealing process, most organic or plastic materials cannot be used. Typical wrapping materials include heat resistant cloth or tape, such as ceramic cloth or tape, fiberglass cloth or tape or silica cloth or tape. Cloth or tape made from certain organic materials may be used, such as cloth or tape made from aramid (polyamide) fibers. Specific examples of heat resistant materials that may be used include THERMEEZ® ceramic tape manufactured by Cotronics Corporation of Brooklyn, N.Y.; NEXTEL® 312 ceramic tape made by the 3M Company of Minneapolis, Minn.; KAPTON® tape #B-652 manufactured by W. H. Brady Co.; and cloth or tape made from NOMEX® or KEVLAR® aramid fibers.

According to the novel method disclosed herein, an amorphous metal transformer core is made by first providing a amorphous metal core formed from a stack of amorphous metal laminations, such as is illustrated in FIGS. 1 and 2, the core 10 having two legs, 16, 18, which are connected by a top yoke 12 and a bottom yoke 14.

Each of the legs 16 and 18 are then wrapped in a sheet of flexible material 22, which is capable of withstanding, without degradation, the temperature which is required to anneal the amorphous metal laminations. Optionally, as illustrated in FIG. 4, wrap 23 of upper yoke 12 may also be applied. The core 10 is then heated to a temperature which is sufficient to anneal the amorphous metal laminations.

The wrap 22 is a non-removable wrap which helps to maintain the dimensions of the core, increases the rigidity of the core, and consolidates the laminations within the core. A temporary removable fixture, in addition to the non-removable wrap 22, may also be used to maintain core dimensions, increase rigidity of the core, and consolidate the laminations in the core. Wrapping 22 may be applied to either a jointed core or an unjointed core, and may optionally be applied to the top yoke as illustrated in FIG. 4. However, in any event, no wrap is provided around the bottom yoke 14 of a jointed core since such a wrapping would prevent unjoining of the core to allow lacing of the core loop through the coil windings.

Although certain presently preferred embodiments of the invention have been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What is claimed is:

1. A method of making an amorphous metal core for use in a transformer comprising the steps of:

providing an amorphous metal core formed from a stack of amorphous metal laminations, said core having two legs which are connected by a top and a bottom yoke, each of said legs having a linear portion;

wrapping each of said legs with a sheet of flexible, non-metallic material which is capable of withstanding, without degradation, the temperature which is required to anneal the amorphous metal laminations, said wrapping step further comprising wrapping the entire linear portion of each of said legs with said sheet material; and after said wrapping step, heating the wrapped metal core to a temperature which is sufficient to anneal the amorphous metal laminations.

2. The method of claim 1, wherein said top yoke is unjointed and said bottom yoke is jointed, further including the step of wrapping said top yoke with a sheet of said flexible material with which said legs are wrapped, said top yoke wrapping step being performed before said step of heating the wrapped metal core.

3. The method of claim 1, wherein said sheet of material is formed as an open mesh.

4. The method of claim 1, wherein said sheet is coated with an adhesive to facilitate said wrapping.

5. The method of claim 1, wherein said sheet comprises a high temperature resistant inorganic material.

6. The method of claim 5, wherein said material comprises glass.

7. The method of claim 1, wherein said sheet is formed from a material which retains sufficient strength after said annealing to consolidate said lamination stack and increase the rigidity of said annealed core.

8. The method of claim 1, wherein said wrapping step further comprises wrapping said legs with said sheet material so that said sheet material directly contacts the amorphous metal laminations of the legs of said core.

9. The method of claim 1, including the step of applying an adhesive between said core and said sheet material.

10. The method of claim 1, wherein the temperature of said heating step is in the range of about 330°-380° C.

11. A method of making an amorphous metal core for use in a transformer comprising the steps of:

providing an amorphous metal core formed form a stack of amorphous metal laminations, said core having two legs which are connected by a top and a bottom yoke, said legs each having a linear portion;

wrapping each of said legs with a sheet of flexible material which is capable of withstanding, without degradation, the temperature which is required to anneal the amorphous metal laminations such that said sheet material directly contacts said metal laminations and said linear portions are substantially completely enclosed by said sheet material; and after said wrapping step, heating the wrapped metal core to a temperature which is sufficient to anneal the amorphous metal laminations.

12. The method of claim 11, wherein the temperature of said heating step is in the range of about 330°-380° C.

* * * * *